US006191391B1

(12) United States Patent
Deo et al.

(10) Patent No.: US 6,191,391 B1
(45) Date of Patent: Feb. 20, 2001

(54) WARMER DRAWER FOR A COOKING RANGE

(75) Inventors: Subhash R. Deo, Hendersonville; George R. Brake, Dickson; James E. Pryor, Clarksville; James E. Peppers, Goodlettsville; Cecilia M. Lankford, Hendersonville, all of TN (US); Victor P. Smith, Marysville, OH (US)

(73) Assignee: White Consolidated Industries, Inc., Cleveland, OH (US)

( * ) Notice: Under 35 U.S.C. 154(b), the term of this patent shall be extended for 0 days.

(21) Appl. No.: 08/769,105

(22) Filed: Dec. 18, 1996

Related U.S. Application Data

(60) Provisional application No. 60/010,578, filed on Jan. 25, 1996.

(51) Int. Cl.[7] ..... F27D 11/00

(52) U.S. Cl. ..... 219/407; 126/273 R; 126/275 E

(58) Field of Search ..... 392/411, 493; 219/405, 407, 385, 386, 387, 400, 444, 454, 393–4, 403, 391, 394–95, 398, 408, 412–14

(56) References Cited

U.S. PATENT DOCUMENTS

| | | | |
|---|---|---|---|
| 273,730 | 3/1883 | Harlow . | |
| 2,290,572 | 7/1942 | Rakov . | |
| 2,535,379 | 12/1950 | White . | |
| 2,566,553 | 9/1951 | Cline . | |
| 2,632,434 | 3/1953 | Pearce . | |
| 2,715,898 | 8/1955 | Michaelis et al. . | |
| 2,872,557 | 2/1959 | Thrasher . | |
| 3,057,343 | 10/1962 | Nelson et al. . | |
| 3,161,755 | 12/1964 | Tilus . | |
| 3,176,118 | 3/1965 | Scott . | |
| 3,335,262 | 8/1967 | Smart et al. . | |
| 3,404,258 | 10/1968 | Winkler . | |
| 3,490,823 * | 1/1970 | Neu et al. | 312/270.3 |
| 3,598,962 | 8/1971 | Badnaruk . | |
| 3,613,656 | 10/1971 | Henderson . | |
| 3,692,351 | 9/1972 | Christopher et al. . | |
| 3,751,635 * | 8/1973 | Niehaus | 219/499 |
| 3,819,247 * | 6/1974 | Evans | 312/330 |
| 3,923,037 | 12/1975 | Donato . | |
| 4,039,776 | 8/1977 | Roderick . | |
| 4,041,277 | 8/1977 | Shumrak et al. . | |
| 4,065,659 * | 12/1977 | Yount | 219/386 |
| 4,317,025 * | 2/1982 | Starnes | 219/386 |
| 4,345,143 * | 8/1982 | Craig | 392/411 |
| 4,444,175 | 4/1984 | Reynolds . | |
| 4,474,107 | 10/1984 | Cothram . | |
| 4,516,485 | 5/1985 | Miller . | |
| 4,579,402 | 4/1986 | Wenzlick . | |

(List continued on next page.)

FOREIGN PATENT DOCUMENTS

| | | | |
|---|---|---|---|
| 3015286 * | 11/1980 | (DE) | A47J/37/00 |
| 4104962 * | 2/1991 | (DE) | F24C/15/18 |

*Primary Examiner*—Teresa Walberg
*Assistant Examiner*—Thor Campbell
(74) *Attorney, Agent, or Firm*—Pearne & Gordon LLP

(57) ABSTRACT

A warming drawer for a domestic range which is disposed within a heating chamber located relatively beneath the oven. The heating chamber is surrounded by a series of panels, and has a heating element disposed therein. The heating element is energized in accordance with a user-determined duty cycle such that temperature within the heating chamber is maintained between a predetermined minimum temperature and a predetermined maximum temperature. The range of temperatures between the predetermined minimum and predetermined maximum correspond to a range of desired food serving temperatures at the warmer drawer.

5 Claims, 13 Drawing Sheets

U.S. PATENT DOCUMENTS

| | | | | |
|---|---|---|---|---|
| 4,605,840 | * | 8/1986 | Koopman | 219/400 |
| 4,623,781 | * | 11/1986 | Thomas | 219/413 |
| 4,759,341 | | 7/1988 | McFarland . | |
| 4,839,502 | * | 6/1989 | Swanson | 219/405 |
| 4,910,386 | | 3/1990 | Johnson . | |
| 5,196,638 | | 3/1993 | Massacesi . | |
| 5,197,378 | | 3/1993 | Scalise . | |
| 5,352,866 | * | 10/1994 | Cartwright et al. | 219/497 |
| 5,417,148 | * | 5/1995 | Cavallo | 99/334 |
| 5,466,058 | | 11/1995 | Chan . | |
| 5,519,188 | * | 5/1996 | Yuichi | 219/407 |
| 5,619,613 | * | 4/1997 | Otaki | 392/97 |

* cited by examiner

WARMER DRAWER FOR A COOKING RANGE

CROSS-REFERENCE TO RELATED APPLICATION

This application claims the benefit of U.S. Provisional Application No. 60/010,578, filed Jan. 25, 1996.

BACKGROUND OF THE INVENTION

1. Field of the Invention

The present invention pertains to domestic cooking ranges and, more particularly, to domestic cooking ranges having a warming drawer adapted to receive and maintain cooked hot food at an above-ambient temperature.

2. Description of Related Art

Domestic cooking ranges traditionally include an open space relatively beneath the oven which slidably receives a storage drawer in which the user may store various articles, such as cooking pots and/or pans. As such, the conventional or prior art drawer is only useful for storage purposes, and could not be used to heat or warm food.

The space occupied by the storage drawer has also, in the past, been used as a broiling cavity which receives a broiling tray. A broiling element is located relatively above the broiling tray. The broiling element is operated at high temperatures as required to accomplish the broiling function.

The prior art references which include a broiling element do not control energization of the broiling element to only warm food contained on the broiling tray. Rather, the broiling element is typically operated exclusively at full power, as required for broiling. Due to the high-energy or high-heat output of the broiling element, maintaining food at an above-ambient temperature for warming purposes, but still low enough so that further cooking does not occur, is not possible.

Therefore, there exists a need in the art for a cooking appliance which provides a warmer drawer in which heating or warming of food is permitted. There also exists a need in the art for a warming device wherein the temperature of the food within the device is controlled such that further cooking of the food, which may degrade the food quality, does not occur.

SUMMARY OF THE INVENTION

In accordance with the present invention, a cooking appliance includes a cabinet, an oven wrapper disposed within the cabinet, a warmer liner, a heating element, and a warmer drawer which is slidably secured to the cooking appliance. The oven wrapper has a generally inverted U-shape including a pair of lateral side walls. The oven liner includes a liner top wall and a liner bottom wall disposed generally between the wrapper lateral side walls. The heating element is secured to the liner bottom wall relatively beneath said warmer drawer.

In further accordance with present invention, a method for controlling a warmer drawer heating element to maintain a temperature within a heating chamber between a predetermined maximum and a predetermined minimum, wherein said warmer drawer heating element is disposed within said heating chamber, include the steps of moving a heater control switch from an off position to a user-selected position, said user selected position corresponding to a duty cycle of heater element operation; energizing said heater element at full power; sensing the temperature within said heating chamber; terminating full power energization of said heater element at said predetermined maximum temperature; and energizing said heater element at said predetermined duty cycle.

In further accordance with the present invention, a cooking appliance includes a cabinet, a lower heating chamber adapted to receive a food-receiving member, a heating element disposed within said heating chamber and relatively beneath the food-receiving member, and means for controlling energization of the heating element such that a temperature within said heating chamber is maintained between a predetermined minimum and a predetermined maximum. The range of temperatures between the predetermined maximum and predetermined minimum correspond to a range of desired food serving temperatures within the warmer drawer.

BRIEF DESCRIPTION OF THE DRAWINGS

Features of the present invention will be apparent with reference to the following description and drawings, wherein.

DETAILED DESCRIPTION OF THE PREFERRED EMBODIMENT

Figure 1:
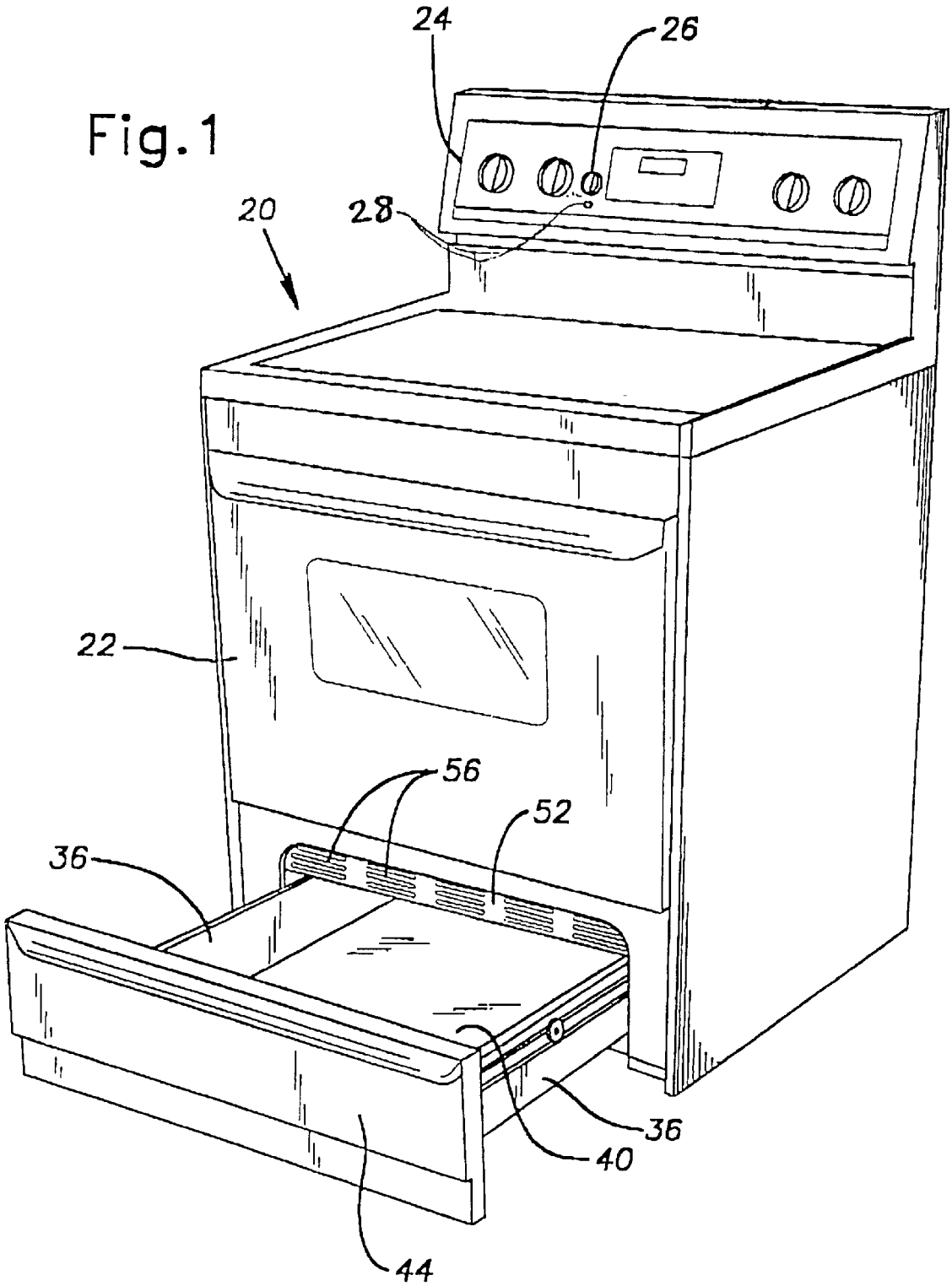
FIG. 1 is a perspective view of a cooking range with a food warmer drawer in a fully extended position.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

With reference to FIG. 1, a household range 20 incorporating the present invention is illustrated. The range includes a cabinet to which an oven door 22 is secured so as to permit pivotal movement of the door about its bottom edge. The cabinet includes a top panel which includes surface heating elements (not shown). A control panel 24 extends upwardly from adjacent a rear portion of the top panel, and includes a plurality of control devices, such as dials, switches, buttons, and/or knobs.

The control devices provided by the control panel include a warmer drawer heater control switch 26, and associated indicator light 28. Preferably, the warmer drawer heater control switch 26 is rotatably mounted to the control panel, and is movable in a push-and-turn fashion to any user-selected position between an off position, and a high heat position. More preferably, the warmer drawer heater control switch 26 is an infinite switch wherein the duty cycle (ratio of heater on-time to heater on-time plus heater off-time) varies from zero, when the switch is set to the off position, to one when the switch 26 is set to the high position.

As will be described more fully hereafter, rotation of the warmer drawer heater control switch 26 between the various user-selected positions varies the duty cycle of a warmer drawer heating element 32. It is believed that operation of infinite switches is well known to one skilled in the art and, therefore, will not be further discussed hereinafter.

Figure 2:
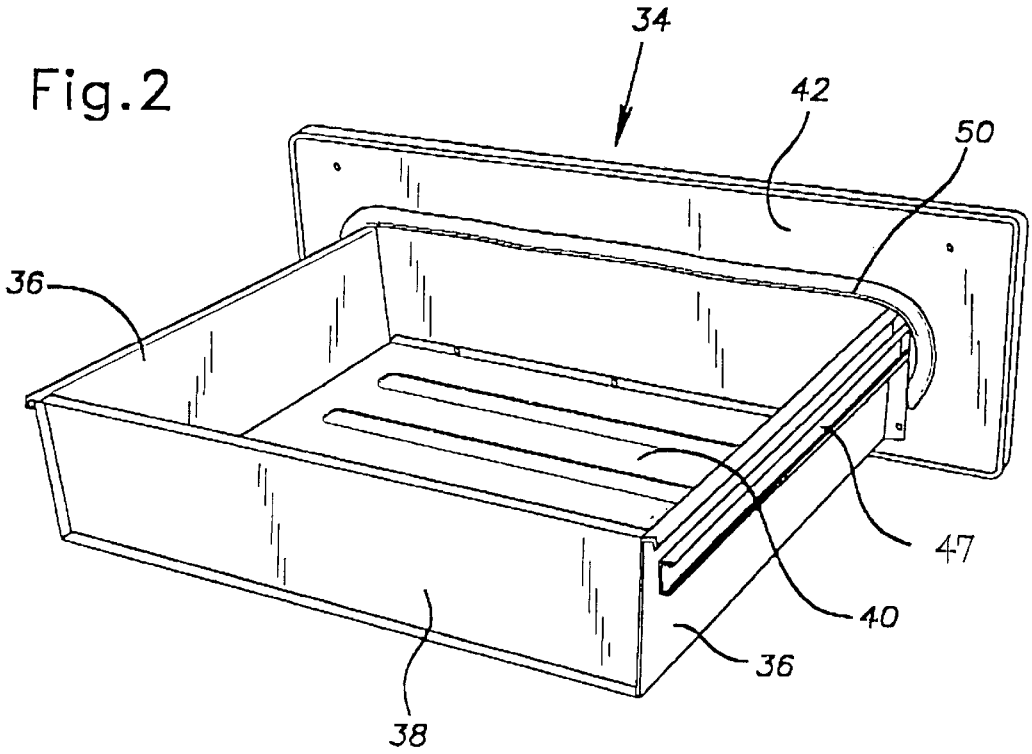
FIG. 2 is a rear perspective view of a food warmer drawer according to the present invention.

With reference to FIG. 2, the warmer drawer 34 according to the present invention is illustrated. The warmer drawer preferably includes a pair of lateral side walls 36, a rear wall 38, a bottom wall 40, and a front wall 42 which cooperate to define a receptacle adapted to receive food stuffs to be maintained at an acceptable above-ambient serving temperature.

The front wall 42 includes a front panel 44 from which a handle extends (FIG. 1). Each of the lateral side walls 36 has a first portion 47 of a glide assembly 48 secured thereto, as will be described more fully hereafter.

The front wall and panel 42, 44 extend or project laterally and vertically outboard and perpendicular to the lateral side walls 36 and bottom wall 40 of the drawer. An annular heat seal member or gasket 50 is attached to a rearward facing surface of the front wall 42 and surrounds the lateral side walls 36 and bottom wall 40, as illustrated. When the drawer is in a retracted or closed position, the heat seal member 50 limits the escape of heat from within the warmer drawer 34 and heating chamber 54, to be described hereafter. Preferably, the heat seal member is formed from material commonly used to seal the periphery of the oven door to the cabinet.

The heat seal member 50 does not prevent air from being drawn through slotted openings 56 in the grate 52, as is desirable to supply supplementary combustion air to a lower burner of a gas range. As will be apparent to one skilled in the art, the front grate 52 may be modified and the usable heating chamber height increased accordingly for electric ranges, since supplementary combustion air is not required.

The walls of the warmer drawer 34 are preferably formed from steel, and have a porcelainized inner surface. A porcelain inner surface of the warmer drawer is preferable over a painted surface for a number of reasons. These reasons include heat tolerance, resistance to scratches and wear, ease of cleaning, and aesthetic continuity with other surfaces of the oven. The warmer drawer 34 may receive one or more racks (not shown) which support foodstuffs in a spaced relationship to the bottom wall 40.

Figure 3:
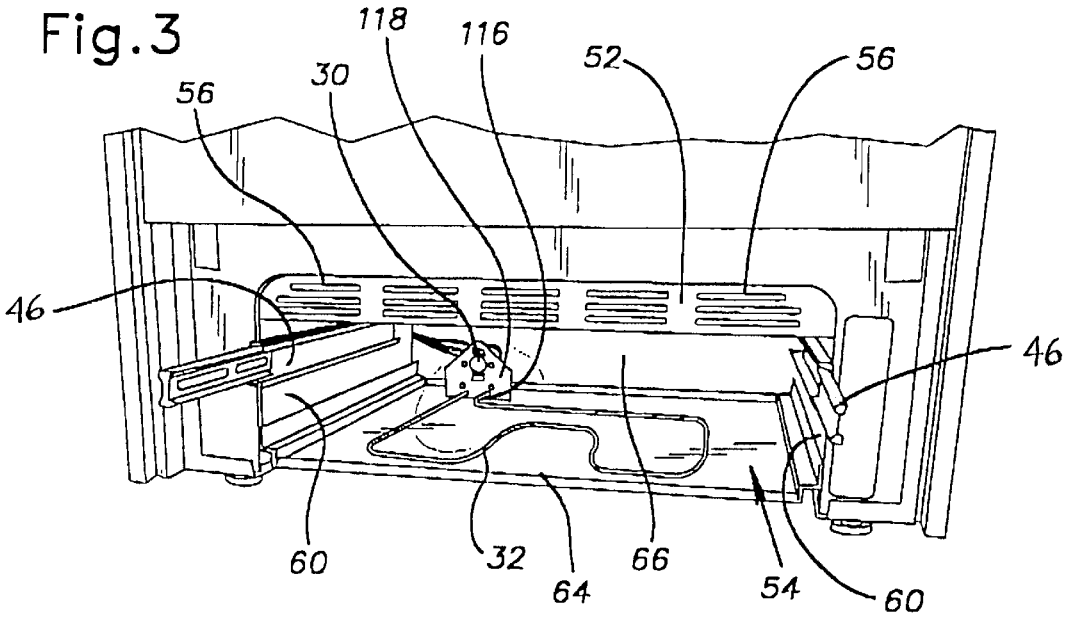
FIG. 3 is a front elevational view of a lower portion of the cooking range shown in FIG. 1, with the food warmer drawer removed therefrom.
Figure 4A:
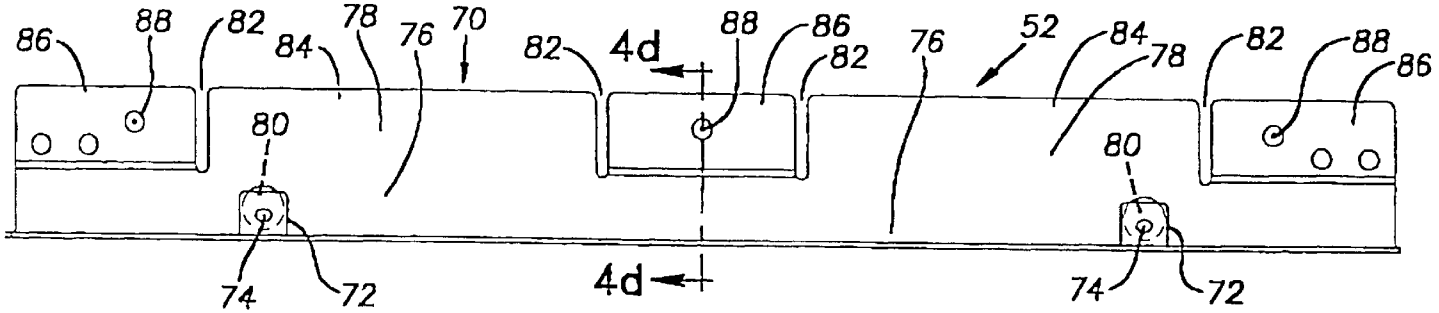
FIG. 4*a,* 4*b,* and 4*c* are, respectively, a front elevational view, a top plan view, and a side elevational view of a front heat shield panel or grate according to the present invention.
Figure 4B:
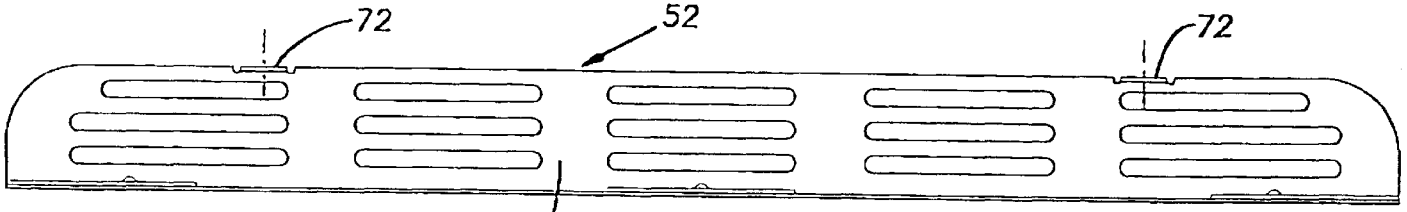
FIG. 4*d* is a cross sectional view of the front heat shield as seen along line 4*d*–4*d* of FIG. 4*a;*
Figure 4D:
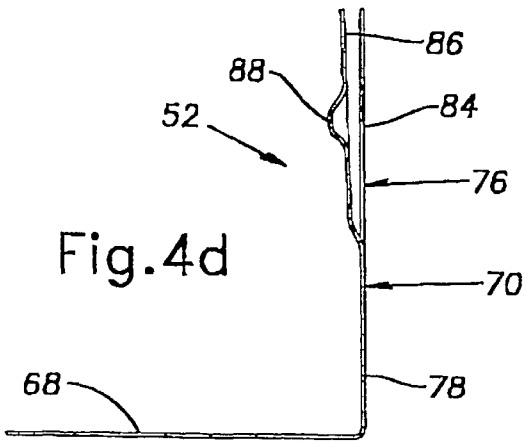
Figure 4C:
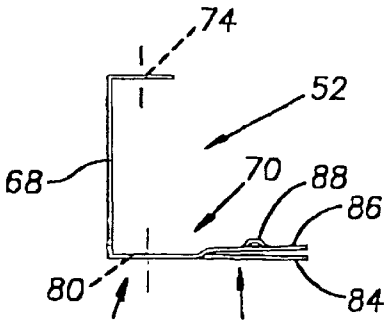
Figure 14:
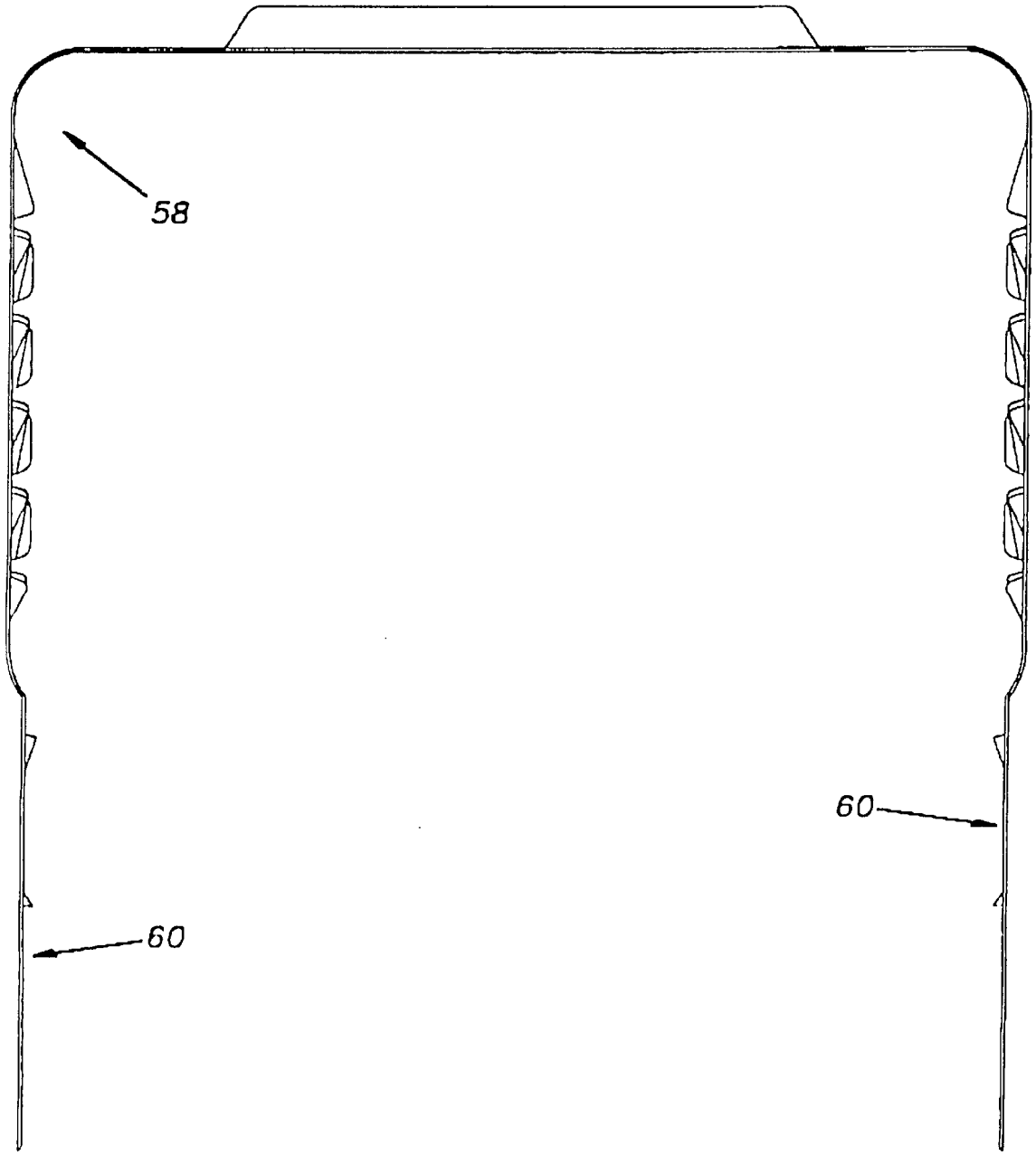
FIG. 14 is a front elevational view of an oven chassis wrapper according to the present invention; and, FIG. 15 is a schematic diagram illustrating a control circuit for the warmer drawer heating element.

With reference to FIG. 3, the range cabinet provides an open space between the bottom of the cooking oven (not shown) and the floor. The open space is defined, in part, by lateral sidewalls 60 of an oven chassis wrapper 58, which is illustrated in FIG. 14. The oven chassis wrapper 58 is generally of an inverted U-shape, and defines the lateral and top walls of the cooking oven. A bottom oven wall (not shown) and rear oven wall (not shown) are mechanically attached, such as by welding, to the oven chassis wrapper to define the cooking oven.

A base portion of the oven chassis wrapper lateral walls 60 defines the lateral extent of the open space. A warmer drawer liner assembly is attached to the cabinet in the open space and cooperates with the lateral walls 60 to define the heating chamber which receives the warmer drawer 34.

The warmer drawer liner assembly includes, in addition to the front panel or grate 52, an upper panel 62, a lower panel 64, and a rear panel 66.

The front panel or grate 52 is secured to the upper panel 62, as will be described more fully hereafter and, with reference to FIGS. 4*a*–4*d,* includes a front wall 68, a bottom wall 70, and a pair of upper tabs 72. The front wall 68 has the slotted openings 56 formed therein, as discussed hereinbefore. The bottom wall 70 and the upper tabs 72 extend rearwardly from the front wall 68.

Each of the upper tabs 72 includes an opening 74 through which a mounting screw is inserted to secure the front panel 52 to a front chassis wall of the range 20 (FIG. 1). The lower wall 70 has a proximal portion 76 adjacent the front wall and a distal portion 78 spaced from the front wall. The proximal portion 76 includes a pair of openings 80 underlying the upper tabs 72 through which access to the tabs may be gained for insertion/removal of the mounting screws.

The distal portion 78 has a series of short slots 82 formed therein which separates the distal portion of the lower wall into an alternating series of first tabs 84 and second tabs 86. The first tabs 84 are generally co-planar with the proximal portion 76 of the bottom wall, while the second tabs 86 are bent upwardly at an angle to the common plane of the first tabs 84 and the proximal portion 76, as illustrated.

The second or angled tabs 86 have openings 88 formed therein through which screws are inserted to secure the upper panel 62 to the front panel or grate 52. As will be described more fully hereafter with reference to assembly of the front panel to the upper panel, the upper panel 62 is inserted relatively above the first tabs 84 and relatively below the second tabs 86, and screws are inserted through the openings in the second tabs 86 and through the upper panel 62 to secure the upper panel 62 to the front panel 52.

The upper panel 62 is secured to the front panel or grate 52, as described hereinbefore, and to the lateral walls 60 of the oven chassis wrapper 58. The upper panel is located rearwardly relative to the front panel or grate, and defines an upper extent of the heating chamber.

Figure 7C:
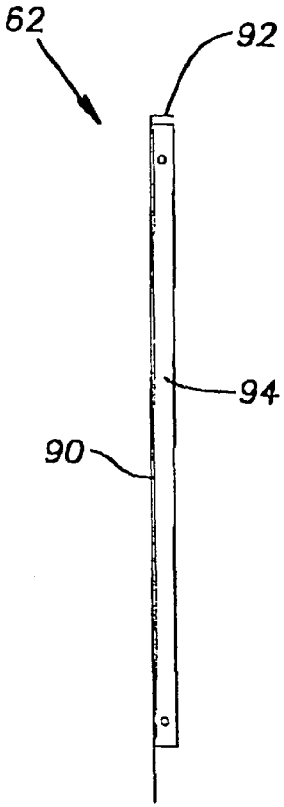
FIG. 7*a,* 7*b,* and 7*c* are, respectively, a bottom plan view, a front elevational view, and a side elevational view of an upper heat shield panel according to the present invention.
Figure 7B:
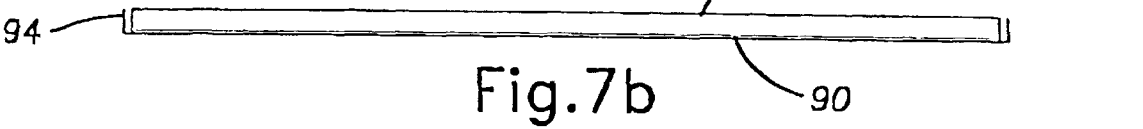
Figure 7A:
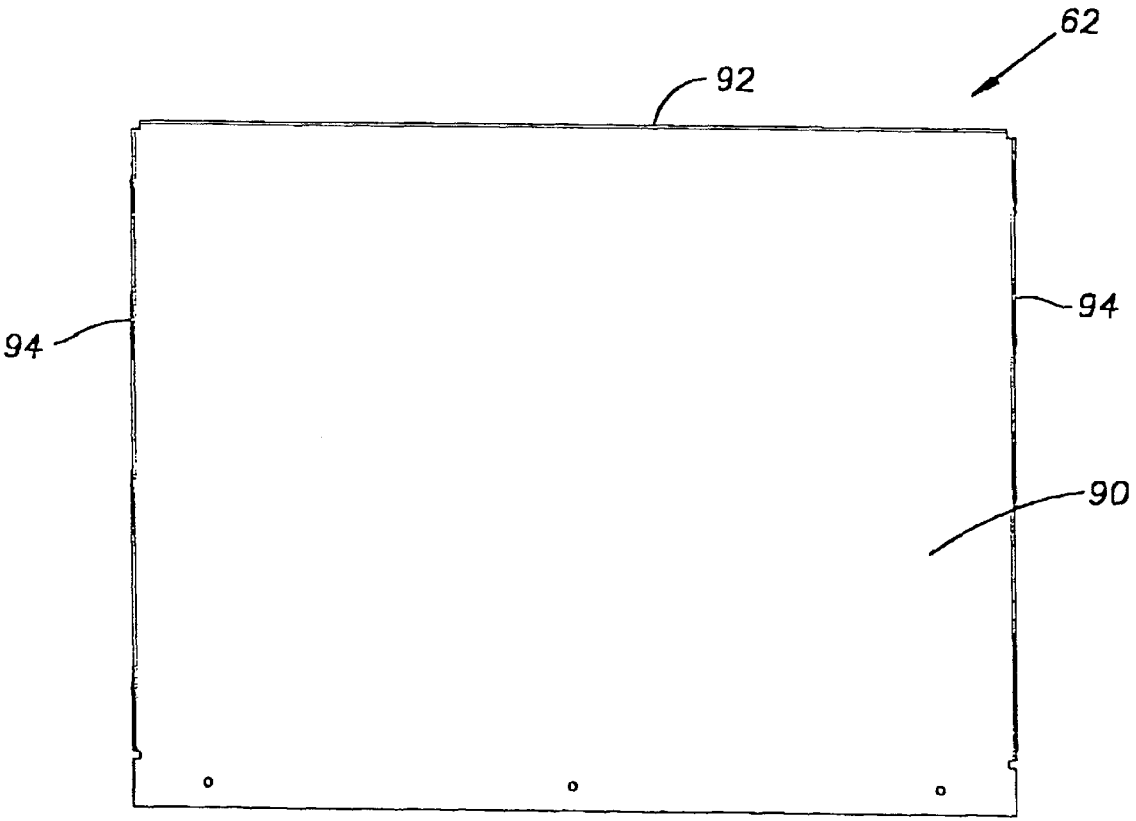

With reference to FIGS. 7*a*–7*c,* the upper panel 62 includes a generally planar plate 90 from which a rearward flange 92 and a pair of lateral flanges 94 are downwardly bent. The lateral flanges 94 include openings through which screws are inserted to secure the upper panel to the lateral walls 60 of the oven chassis wrapper 58. The front edge of the upper panel is slidably inserted between the first and second tabs 84, 86 of the front panel, and includes openings through which screws are inserted to secure the upper panel 62 to the front panel 52, as discussed hereinbefore.

Figure 6A:
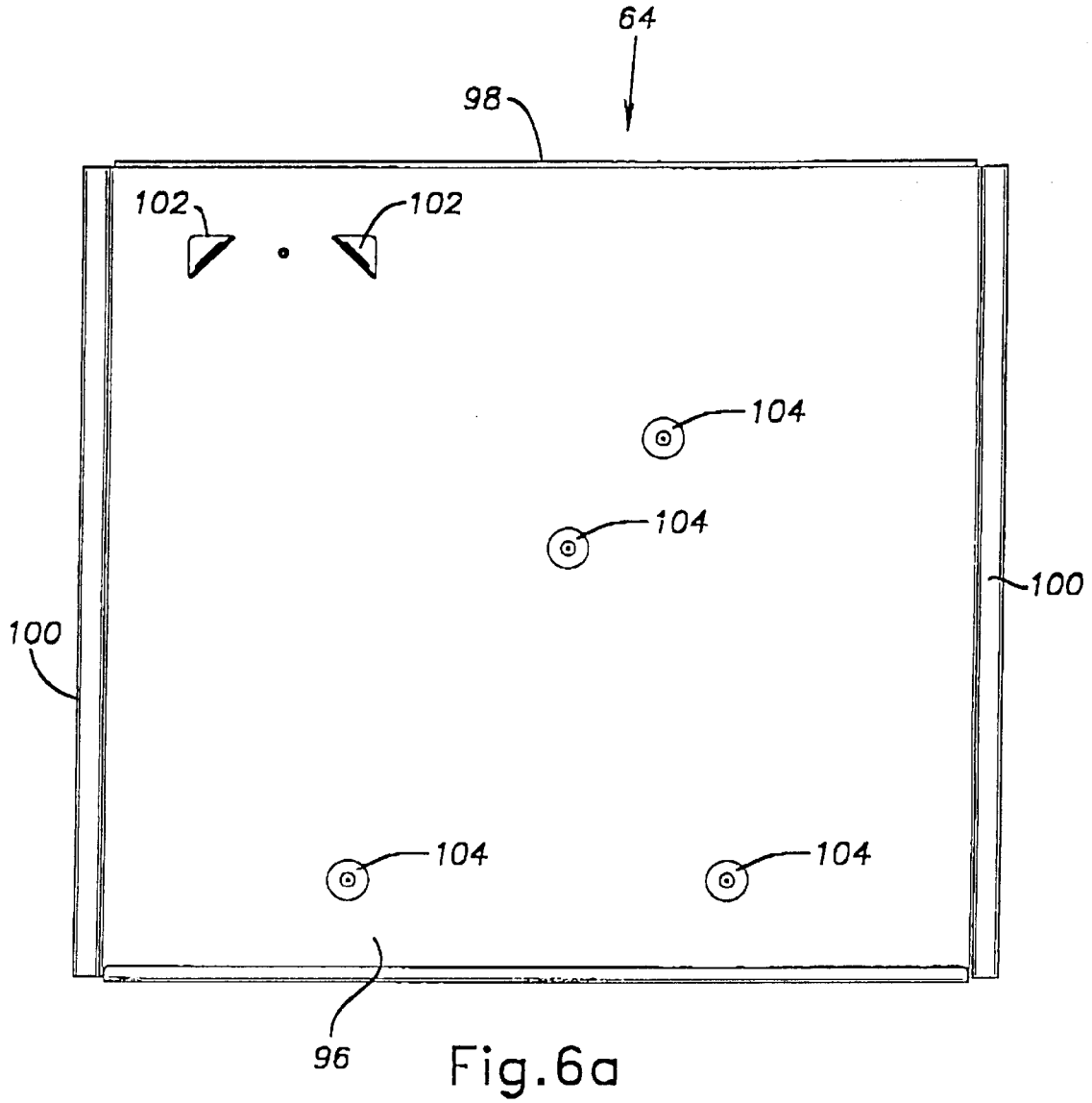
FIG. 6*a,* 6*b,* and 6*c* are, respectively, a top plan view, a front elevational view, and a side elevational view of a lower heat shield panel according to the present invention.
Figure 6B:
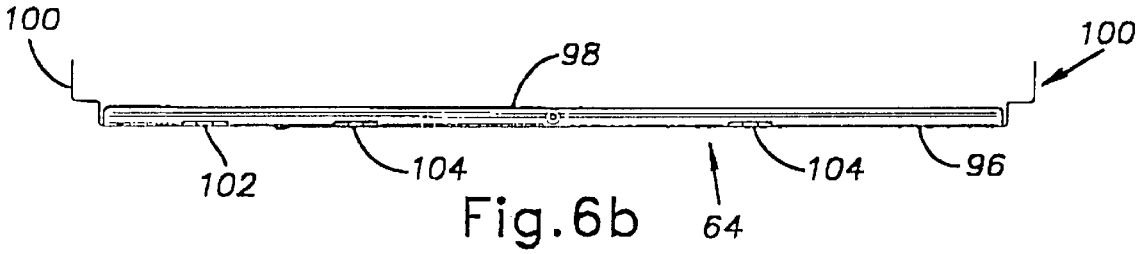
Figure 6C:
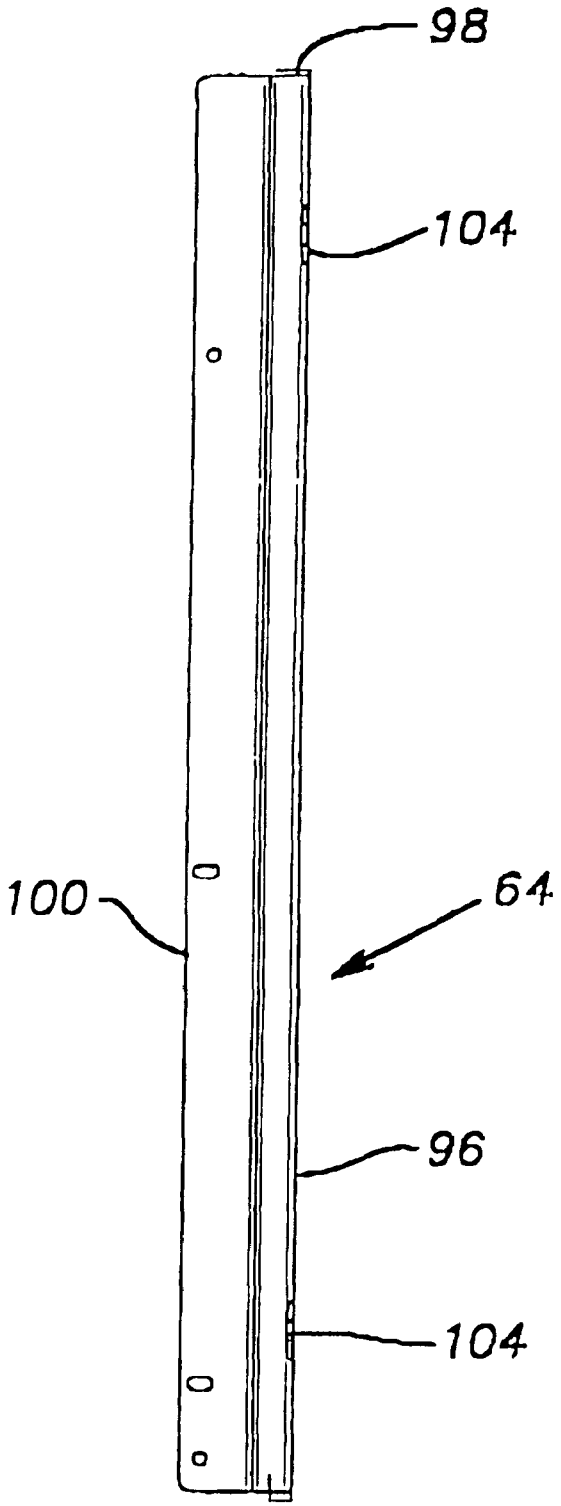

The lower panel 64 is secured to the rear panel 66 and to lateral walls 60 of the oven chassis wrapper, and defines a lower extent of the heating chamber 54. With reference to FIGS. 6*a*–6*c*, the lower panel 64 includes a plate member 96 from which a rear flange 98 and a pair of lateral flanges 100 extend.

The rear flange 98 is bent generally perpendicular to the plate member 96, and is secured to the rear panel 66 by means of a screw. The lateral flanges 100 are generally Z-shaped in cross section, and define openings through which screws extend to secure the lateral flanges to the lateral walls 60 of the oven chassis wrapper 58.

Figure 13:
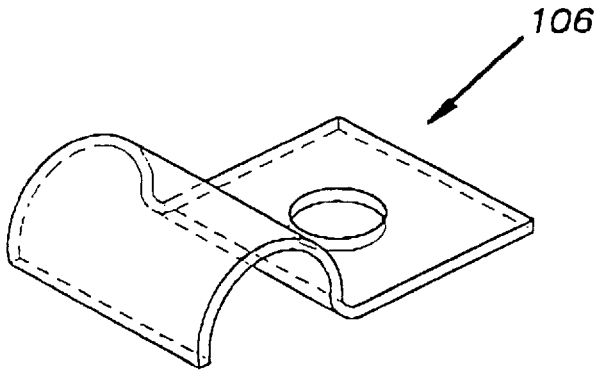
FIG. 13 is a perspective view of a heating element mounting clip according to the present invention.

The plate member 96 also provides a pair of mounting tabs 102 and a series of dimpled mounting openings 104. The mounting tabs 102 are bent upwardly from the plate member 96 and define pockets for receipt of a temperature sensing and circuit enabling/disabling assembly, hereinafter referred to as the temperature sensing assembly. The mounting tabs 102 slidably, yet resiliently, receive the temperature sensing assembly thereunder, as will be described hereafter. The dimpled mounting openings 104 are provided to facilitate securing heating element mounting clips 106 (FIG. 13) to the lower panel 64, as will be described hereafter.

The rear panel 66 is secured to the lower panel 64 and to the lateral walls 60 of the oven chassis wrapper 58, and extends between rearward edges of the upper and lower panels 62, 64, and between the lateral walls of the oven chassis wrapper. The rear panel defines a rearward extent of the heating chamber 54.

Figure 5C:
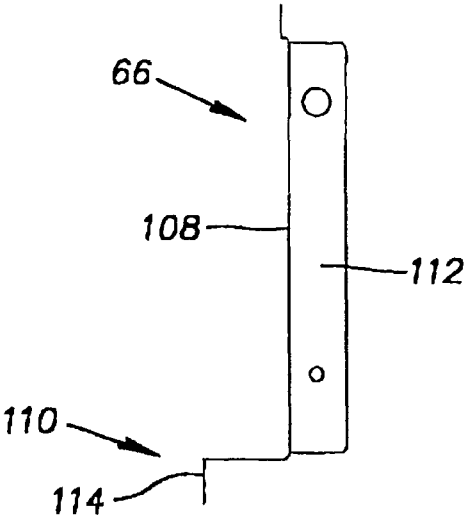
FIG. 5*a,* 5*b,* and 5*c* are, respectively, a front elevational view, a top plan view, and a side elevational view of a rear heat shield panel according to the present invention.
Figure 5B:
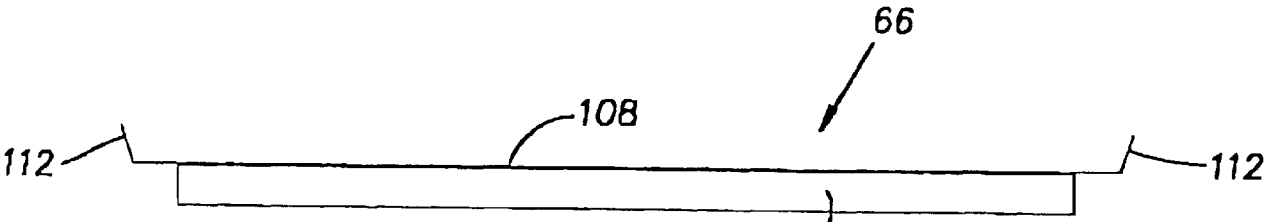
Figure 5A:
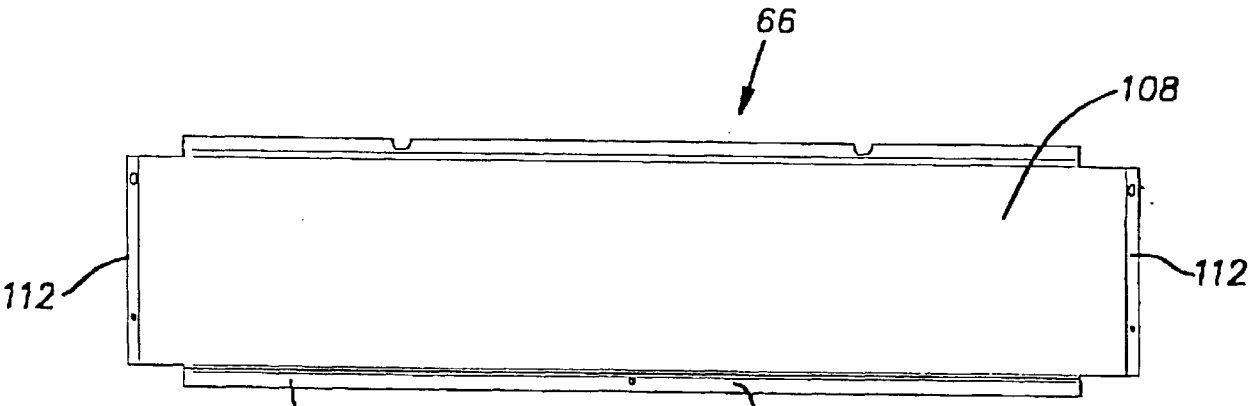

With reference to FIGS. 5*a*–5*c*, the rear panel 66 includes a plate 108 from which a lower flange 110 and a pair of lateral flanges 112 extend. The lateral flanges 112 extend generally rearwardly of the plate 108, and include openings to assist in mechanical securement of the lateral flanges to the lateral walls 60 of the oven chassis wrapper. The lower flange 110 has a generally inverted-L shape, and is adapted to extend out over, and in front of the rear flange 98 of the lower panel 64. A vertical face 114 of the lower flange 110 includes an opening through which a mounting screw extends to secure the lower flange 110 to the rear flange 98.

As such, the panels 52, 62, 64, 66 cooperate with the oven chassis wrapper 58 to define the heating chamber, which is closed at its lateral sides, rear side, upper side, and lower side, and open at the front. The warmer drawer 34 is slidably inserted into the heating chamber 54, and slidably removed from the heating chamber, by means of the glide assembly 48, to be described further hereafter.

It should be noted that the illustrated warmer drawer liner assembly is intended for an electric range. On gas ranges, the rear panel is not used, and the rearward extent of the heating chamber is defined by a vertical wall which has control devices for the lower gas burner assembly mounted thereto. The vertical wall and control devices are conventional and, therefore, are not specifically illustrated.

Each of the lateral walls 60 of the oven chassis wrapper have a second portion 46 of the drawer glide assembly 48 secured thereto. The first and second portions 47, 46 of the glide assembly 48 cooperate with one another to permit the drawer 34 to be slidably inserted into the heating chamber, and slidably removed from the heating chamber. Also, the first and second glide portions 47, 46 may be disengaged from one another to permit the warmer drawer 34 to be completely disconnected and removed from the range 20, as would be desirable for cleaning and/or maintenance purposes. It is understood that numerous glide assemblies are known in the art, and various other glide assemblies may be substituted for the illustrated glide assembly 48 without departing from the scope and spirit of the present invention.

Figure 8B:
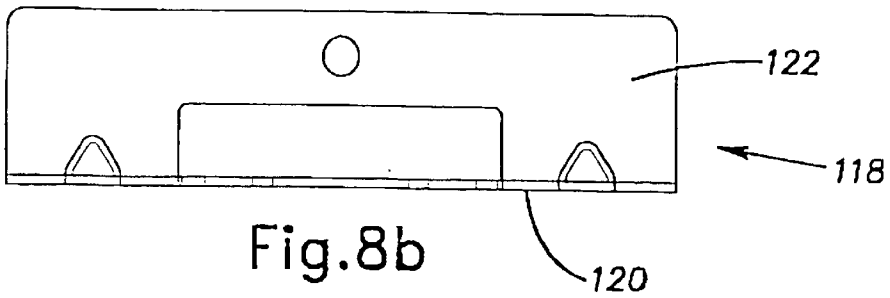
FIGS. 8*a,* 8*b,* and 8*c* are, respectively, a front elevational view, a top plan view, and a side elevational view of a temperature sensor mounting bracket according to the present invention.
Figure 8A:
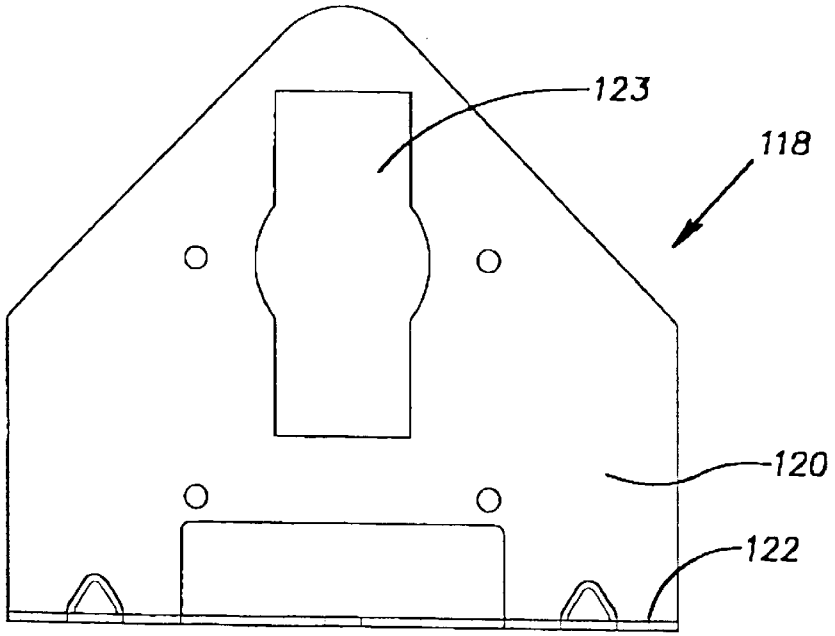
Figure 8C:
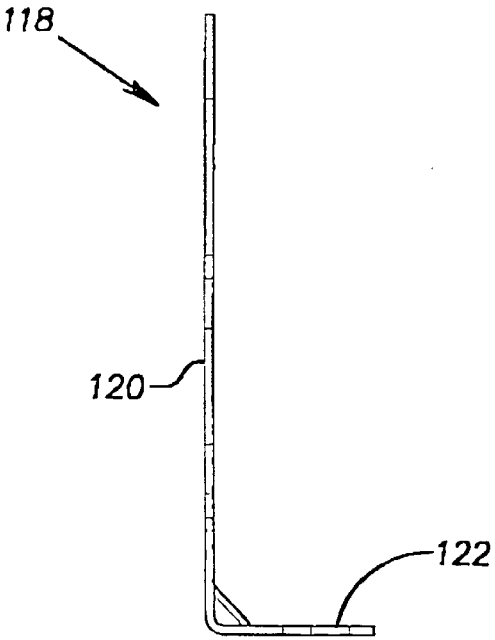
Figure 9A:
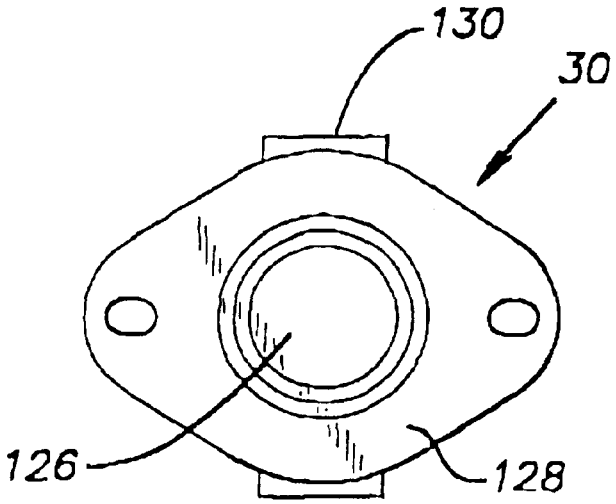
FIGS. 9*a,* 9*b,* and 9*c* are, respectively, a front elevational view, a top plan view, and a side elevational view of a warmer drawer temperature sensor according to the present invention.
Figure 9C:
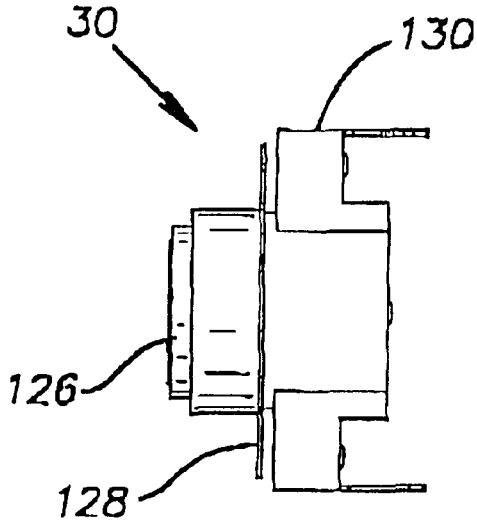
Figure 9B:
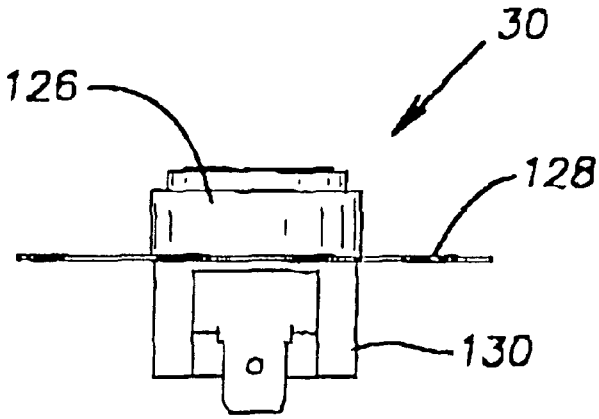
Figure 10:
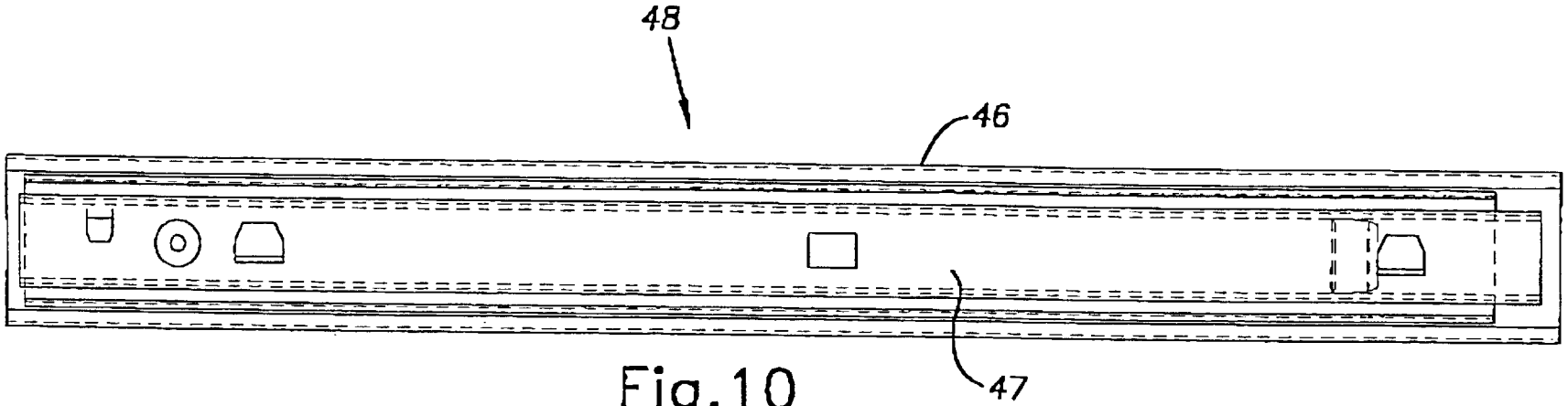
FIG. 10 is a side elevational view of a warmer drawer glide assembly according to the present invention.
Figure 11:
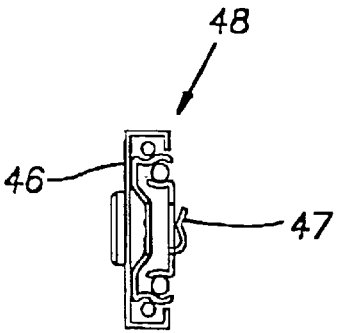
FIG. 11 is an end elevational view of the warmer drawer glide assembly shown in FIG. 10.
Figure 12:
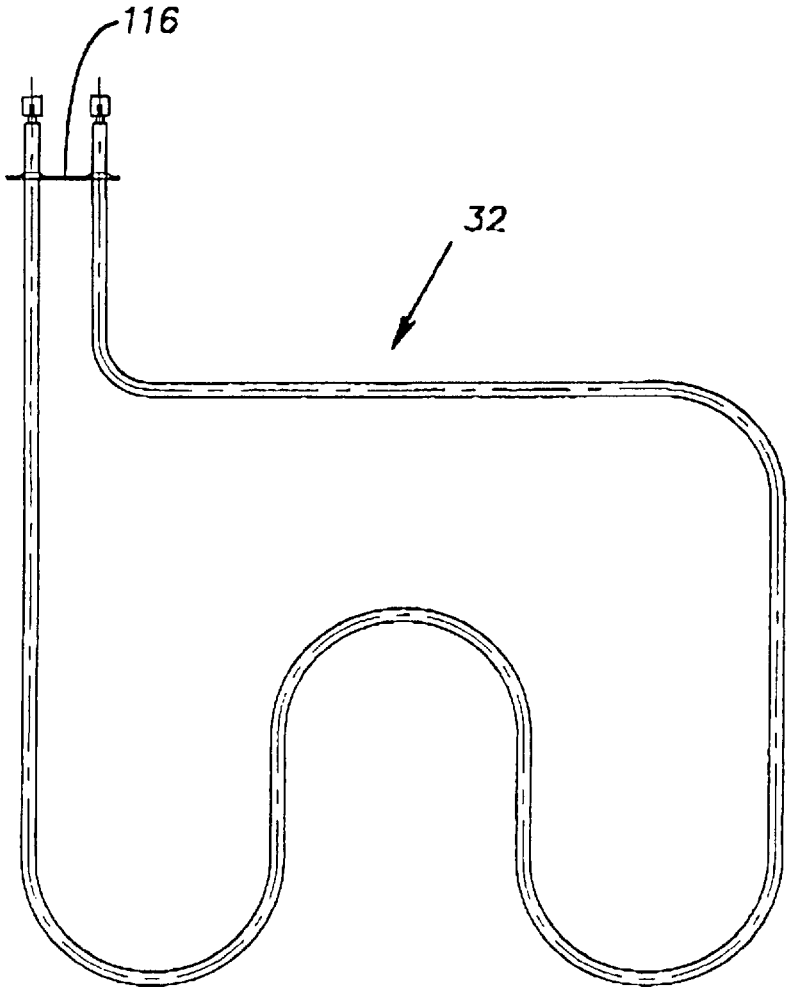
FIG. 12 is top plan view of a heating element according to the present invention.

The heating element 32 (FIG. 12) and temperature sensing assembly (FIG. 3) are disposed within the heating chamber 54 and secured to the lower panel 64. The heating element 32 preferably comprises a tubular, electrical resistance-type heating element which is fastened to the lower panel 64 via the mounting clips 106 (FIG. 13) and a mounting bracket 118 (FIG. 8*a*–8*c*). The mounting clips 106 are attached to the mounting openings 104 in the lower panel and clamp the heating element 32 to the lower panel 64. Naturally, more or less than the illustrated four mounting clips 106 may be used to secure the heating element 32 to the lower panel 64, if desired.

A mounting plate 116 of the heating element 32 is secured to the mounting bracket 118 of the temperature sensing assembly, as will be described hereafter. The heating element 32 is electrically connected to a temperature sensor 30, and is powered in accordance with the user-selected setting of the control switch 26 and as-needed to maintain the temperature within the heating chamber 54, as sensed by the temperature sensor 30, within a predetermined desired range of operating temperatures, as will be described hereinafter with reference to the control circuit illustrated in FIG. 15.

The temperature sensing assembly includes the temperature sensor 30 and the mounting bracket 118. The temperature sensor 30 is secured to the mounting bracket 118 in an elevated position, as illustrated in FIG. 3, and is operable to sense the temperature within the heating chamber 54.

With reference to FIGS. 8*a*–8*c*, the mounting bracket 118 includes a body member 120 from which a base flange 122 extends rearwardly. The base flange is slidably received under the mounting tabs 102 and mechanically attached, preferably by a screw, to the lower panel 64. The body member 120 defines an elongated opening 123 which receives the temperature sensor 30, and includes a plurality of openings through which fasteners extend to secure the temperature sensor 30 and the heating element mounting plate 116 to the mounting bracket 118.

The temperature sensor 30 has a forwardly projecting sensor portion 126, a mounting flange 128, and a rearwardly extending connector portion 130. The mounting flange 128 includes a pair of lateral openings through which fasteners extend to secure the temperature sensor 30 to the mounting bracket 118. The temperature sensor 30 is inserted through the elongated opening 123 in the mounting bracket body, such that the sensor portion 126 faces toward the warmer drawer 34 and the open front of the heating chamber 54 and the connector portion 130 faces toward the rear panel 66. The connecting portion 130 is electrically connected, via suitable conductors, to the control switch 26 and the heating element 32.

The location of the sensor 30 and mounting bracket 118 gives the control circuit its ambient compensation characteristics. For example, and as will be apparent from the description to follow, relatively more heat may have to be input into the heating chamber to reach the predetermined maximum temperature during low ambient conditions than during high ambient conditions. Putting more heat into the heating chamber during low ambient may help reduce cycling as the time required to reach the minimum temperature will be extended. Moreover, the temperature within the warmer drawer corresponding to the predetermined maximum heating chamber temperature may be relatively higher during low ambient conditions than during high ambient conditions. For high ambient conditions, less heat may be required to reach the predetermined maximum heating chamber temperature, and less heat is lost to atmosphere, so temperature within the heating chamber and the warmer drawer may be relatively more uniform and static.

The warmer drawer 34 of the present invention is located relatively above the heating element 32 and, therefore, the present invention takes advantage of the natural tendency of relatively hot air to rise. As such, the food stuffs contained within the drawer 34 are in a relatively hot portion of the heating chamber 54. As mentioned briefly hereinbefore, it may be desirable to place one or more removable racks within the drawer 34 to space the foods being warmed away from the bottom wall 40 of the drawer. Spacing of the food from the bottom wall 40 permits warm air to flow beneath the food and facilitates more even heating thereof. Spacing of the food from the bottom wall 40 also prevents localized over-heating of the food at the interface with the bottom wall, since the bottom wall will be relatively hot, as compared to air within the heating chamber 54, due to the proximity of the bottom wall to the heating element 32.

Figure 15:
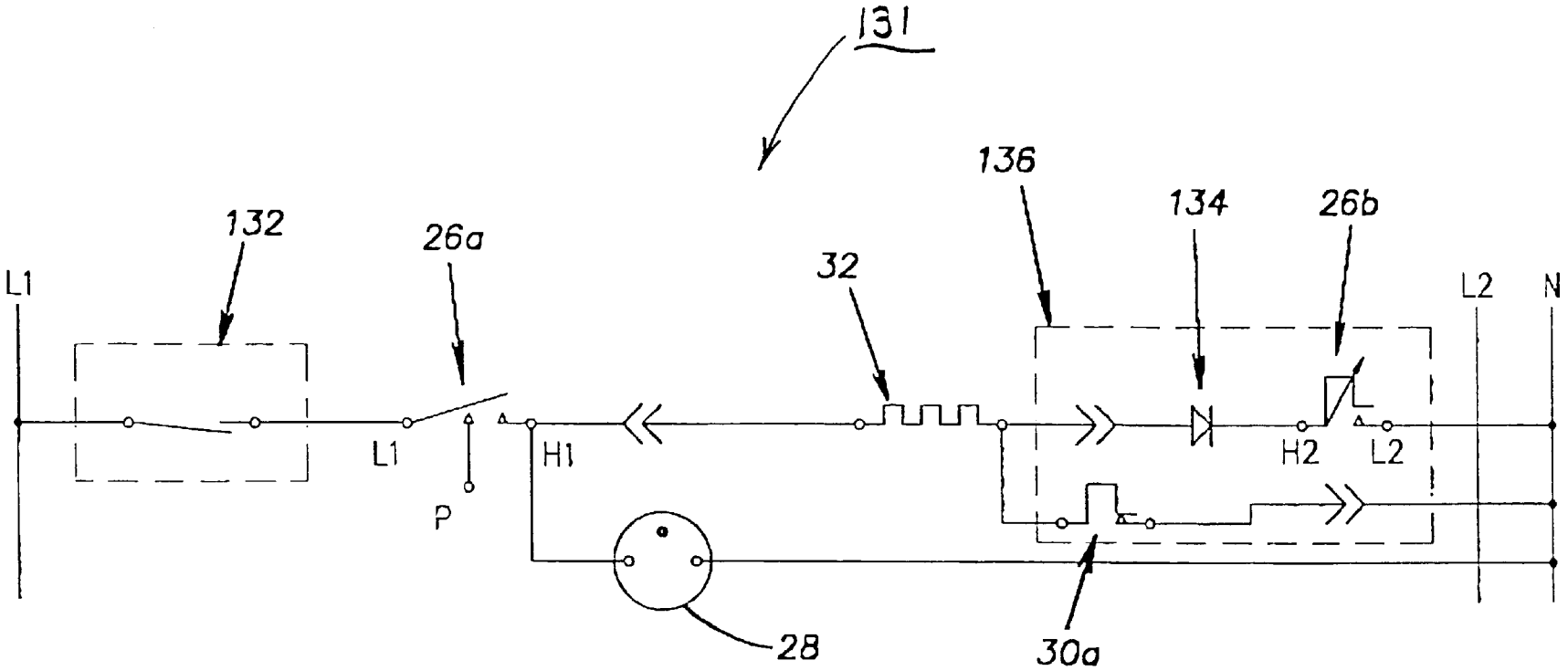

With reference to FIG. 15, a control circuit 131 for the warmer drawer heating element 32 is illustrated. The circuit 131 generally includes an oven self-cleaning cycle lock-out switch 132, the heater control switch 26, the warmer indicator light 28, the temperature sensor 30, the warmer drawer heating element 32, and a diode 134. The heater control switch 26 provides first and second pairs of contacts 26*a*, 26*b*. The first pair of contacts 26*a* are closed whenever the switch 26 is turned on. The second pair of contacts open and close when the switch 26 is turned on, the frequency of opening and closing depending upon the angular position of the switch 26 to vary or adjust the duty cycle of heater operation. For example, when the heater control switch 26 is turned to "high", the second pair of contacts 26*b* are mechanically locked in a closed position whereas, when the switch 26 is turned to the "low" position, the second pair of contacts 26*b* will be closed only a portion of the time (e.g., 20%) and will be open the rest of the time. It is considered that the above-described operation of the switch 26 is well known in the infinite switch art.

The lock-out switch 132 opens and thereby de-activates or renders inoperable the warmer drawer heating element 32, and the heater control switch 26, when the oven is operated in a self-cleaning mode and, therefore, prevents energization of the heating element 32 during a self-cleaning cycle.

The first pair of heater control switch contacts 26*a* are connected in series with the lock-out switch 132. The warmer indicator light 28 is connected in parallel with the warmer heating element 32 and a heating element energization control circuit 136 and, therefore, is illuminated whenever the heating element 32 is powered to provide visual indication to the user that the warmer heating element 32 is operating.

The temperature sensor 30 provides a thermally-actuated switch 30*a* which is normally-closed. The warmer element energization circuit 136 includes the diode 134 and the second pair of heater control switch contacts 26*b* in parallel with the temperature sensor switch 30*a*, as illustrated. Therefore, when the heater control switch 26 is turned from "off" to any position, the series combination of the second pair of heater control switch contacts 26*b* and the diode 134 is shorted by the parallel branch due to the normally-closed temperature sensor switch 30*a*.

The heating element 32 is therefore in series with the temperature sensor switch 30*a*, and full power is applied to the heating element 32. At this point, no current flows through branch of the energization circuit 136 containing the diode 134 and the second pair of heater control switch contacts 36*b*. This period of operation is referred to herein as the preheating cycle during which the heating element 32 is operated at full power to more quickly bring the warmer drawer 34 up to the maximum operating or peak preheat temperature. When the temperature within the heating chamber 54 reaches the predetermined maximum desired temperature or peak preheat temperature, the temperature sensor switch 30*a* opens and control of the heating element energization is given over to the heater control switch 26. The time required to reach the predetermined maximum temperature depends upon a number of factors, including the size, temperature, and type of food being warmed, and the ambient temperature.

The heating chamber temperature corresponds to the warmer drawer temperature (i.e., food temperature), so that sensing of the heating chamber temperature is an accurate guide to the warmer drawer temperature and, as will be apparent from the following description, the sensed heating chamber temperature is used to control energization of the heating element 32 to maintain the warmer drawer temperature within a range of desired food serving temperatures.

Due to the diode 134, only half-wave rectified current flows through the heating element 32 which, therefore, is limited to half maximum power if the warmer switch is set to "high". As noted hereinbefore, the duty cycle of the heating element operation is controlled by the angular position of the heater control switch 26 which, in turn, corresponds to the rate or frequency of opening/closing of the second pair of heater control switch contacts 26*b*.

The duty cycle controls the amount of power dissipated in the heater element 32 which, in turn, affects the amount of heat energy added to the warmer drawer heating chamber 54 and, hence, the warmer drawer 34. The rate at which the heating chamber temperature falls (from the maximum temperature at the end of the preheat cycle) is affected by the food load within the warmer drawer, the ambient temperature, and the user-selected duty cycle of the warmer drawer heating element 32 (i.e., the angular position of the switch 26).

For example, at a given ambient temperature, if a relatively large, cool item of food is placed in the warmer drawer 34 and the warmer switch 26 is set to the "low" position (which corresponds to a small duty cycle, e.g., 0.20), the temperature within the heating chamber 54 and the warmer drawer 34, following the preheat cycle, will fall faster than if a similarly sized but hotter item of food is placed in the warmer drawer and the warmer switch 26 is set to high (i.e., full one-half power, switch duty cycle equals 1.0). Similarly, if a small, hot food item is placed in the warmer drawer 34 in a low ambient environment and the warmer switch 26 is set to "medium", the temperature within the heating chamber 54 and the warmer drawer will fall faster than if an item of similar size and temperature is placed in the warmer drawer in a high ambient environment and the warmer switch is set to the "medium" position.

If the heating chamber temperature drops below a predetermined minimum desired temperature (which corresponds to a minimum desired serving temperature within the warmer drawer), the temperature sensor contacts close, shorting the branch of the energization circuit 136 containing the diode 134 and the second pair of heater control switch contacts 26*b,* and full power is again applied to the heating element 32 until the heating chamber temperature exceeds the maximum desired temperature (corresponding to the maximum desired serving temperature within the warmer drawer), at which point the temperature sensor contacts open and control is returned to the heater control switch 26 at the user-selected duty cycle. Accordingly, the warmer drawer temperature is maintained between maximum and minimum desired serving temperatures.

As should be apparent from the foregoing, control over energization of the heating element 32 alternates between full power when the temperature sensor contacts close (preheat cycle and low heating chamber/warmer drawer temperature) and the user-selected duty cycle. As noted hereinbefore, the heat input into the heating chamber to reach the maximum desired heating chamber temperature will vary depending at least upon ambient temperature. Similarly, the rate at which the heating chamber temperature falls to the predetermined minimum desired heating chamber temperature will vary depending at least upon ambient temperature, food size and type, and user selected setting of the control switch 26.

It is also noted that the maximum and minimum warmer drawer temperatures may vary in dependence upon ambient temperature. For example, the maximum warmer drawer temperature may be relatively higher in low ambient conditions than in high ambient conditions. Similarly, the minimum warmer drawer temperature may be relatively higher in low ambient conditions than in high ambient conditions. Since relatively more heat is lost to the environment in low ambient conditions than in high ambient conditions, the noted temperature compensation feature reduces cycling of the heater element between the user-selected duty cycle and full power cycle than would otherwise occur. The maximum and minimum warmer drawer temperatures fall within a range of desired food serving temperatures.

While the preferred embodiment of the present invention is shown and described herein, it is to be understood that the same is not so limited but shall cover and include any and all modifications thereof which fall within the purview of the invention.

What is claimed is:

1. A method for controlling an electrical warmer drawer heating element to maintain a temperature within a lower heating chamber, comprising steps of:

providing a range for placement on a floor, providing a cabinet to said range, providing an oven wrapper disposed within said cabinet and at least partially defining an oven chamber, providing the lower heating chamber relatively beneath said oven chamber, providing a fixed panel defining a lower extent of the heating chamber, providing the electrical heating element within said heating chamber, adjacent to the panel, providing the warmer drawer slidably mounted in the lower heating chamber, above the heating element and the panel, providing a temperature sensor disposed within said heating chamber and operable to sense temperature within said heating chamber, and providing controlling means for controlling said heating element such that a temperature within said heating chamber is maintained between a predetermined minimum temperature and a predetermined maximum temperature corresponding to a range of desired food serving temperatures;

moving a heater control switch from an off position to a user-selected position, said user selected position corresponding to a duty cycle of heater element operation;

energizing said heater element at full power;

sensing the temperature within said heating chamber using the temperature sensor;

terminating full power energization of said heater element at said predetermined maximum temperature;

energizing said heater element at said predetermined duty cycle.

2. A method for controlling a warmer drawer heating element according to claim 1, comprising the further steps of:

terminating energization of said heater element at said predetermined duty cycle at said predetermined minimum temperature;

energizing said heater element at full power;

terminating full power energization of said heater element at said predetermined maximum temperature; and resuming energization of said heater element at said predetermined duty cycle.

3. A method for controlling a warmer drawer heating element according to claim 1, wherein said controlling means comprise the temperature sensor and an infinite switch.

4. A method for controlling a warmer drawer heating element according to claim 3, wherein, during a preheating cycle, said temperature sensor provides full power to said heating element to bring the temperature of said heating chamber to said maximum temperature.

5. A method for controlling a warmer drawer heating element according to claim 4, wherein, following said preheating cycle, power to said heating element is supplied in accordance with a user-selected duty cycle via said infinite switch.

* * * * *